US008505618B2

(12) United States Patent
Ogawa et al.

(10) Patent No.: US 8,505,618 B2
(45) Date of Patent: Aug. 13, 2013

(54) HEAT TRANSFER FIN AND FIN-TUBE HEAT EXCHANGER

(75) Inventors: Osamu Ogawa, Kyoto (JP); Kou Komori, Nara (JP); Hiroki Hayashi, Kyoto (JP)

(73) Assignee: Panasonic Corporation, Osaka (JP)

( * ) Notice: Subject to any disclaimer, the term of this patent is extended or adjusted under 35 U.S.C. 154(b) by 1311 days.

(21) Appl. No.: 12/297,163

(22) PCT Filed: Apr. 4, 2007

(86) PCT No.: PCT/JP2007/057547

§ 371 (c)(1), (2), (4) Date: Oct. 14, 2008

(87) PCT Pub. No.: WO2007/122996

PCT Pub. Date: Nov. 1, 2007

(65) Prior Publication Data

US 2009/0133863 A1 May 28, 2009

(30) Foreign Application Priority Data

Apr. 21, 2006 (JP) ..... 2006-117591

(51) Int. Cl.

| | |
|---|---|
| ***F28D 1/04*** | (2006.01) |
| ***F28F 1/20*** | (2006.01) |
| ***F28F 1/30*** | (2006.01) |
| ***F28F 1/14*** | (2006.01) |

(52) U.S. Cl.

USPC ..... 165/151; 165/181; 165/182; 165/183

(58) Field of Classification Search

USPC ..... 165/151, 181–183; 29/890.038, 29/890.045–890.047

See application file for complete search history.

(56) References Cited

U.S. PATENT DOCUMENTS

| | | | | | |
|---|---|---|---|---|---|
| 1,739,672 | A | * | 12/1929 | Higgins | 165/151 |
| 1,982,931 | A | * | 12/1934 | Schank et al. | 165/151 |
| 3,631,922 | A | * | 1/1972 | Ponziani | 165/151 |
| 4,984,626 | A | * | 1/1991 | Esformes et al. | 165/151 |
| 5,628,362 | A | | 5/1997 | Rew et al. | |
| 2008/0164013 | A1 | * | 7/2008 | Maziers | 165/151 |

FOREIGN PATENT DOCUMENTS

| | | | | |
|---|---|---|---|---|
| AU | 487906 | B2 | | 10/1977 |
| DE | 195 31 383 | A1 | | 2/1997 |
| JP | 50-031568 | U | | 7/1973 |
| JP | 50-134168 | U | | 4/1974 |
| JP | 54140253 | A | * | 10/1979 |
| JP | 55075190 | A | * | 6/1980 |
| JP | 55075191 | A | * | 6/1980 |
| JP | 56-133596 | A | | 10/1981 |
| JP | 63-294494 | A | | 12/1988 |
| JP | 64-090995 | A | | 4/1989 |
| JP | 6-300474 | A | | 10/1994 |
| JP | 7-239196 | A | | 9/1995 |
| JP | 11-166796 | A | | 6/1996 |
| JP | 8-170889 | A | | 7/1996 |
| JP | 2001174181 | A | * | 6/2001 |
| WO | WO 00/22366 | A1 | | 4/2000 |

* cited by examiner

*Primary Examiner* — Frantz Jules
*Assistant Examiner* — Erik Mendoza-Wilkenfel
(74) *Attorney, Agent, or Firm* — Hamre, Schumann, Mueller & Larson, P.C.

(57) ABSTRACT

A fin (3) of a fin-tube heat exchanger (1) has protuberances (5) each disposed between two adjacent heat transfer tubes (2, 2) and holes 8 (cut-outs) each formed upstream of the protuberances (5). Each of the protuberances (5) has, as an upstream portion adjacent to the hole (8), a wing portion (6) tapering toward an upstream side.

19 Claims, 10 Drawing Sheets

HEAT TRANSFER FIN AND FIN-TUBE HEAT EXCHANGER

TECHNICAL FIELD

The present invention relates to heat transfer fins and fin-tube heat exchangers.

BACKGROUND ART

Conventionally, various types of heat transfer fins have been used for, for example, home or automobile air conditioners, freezer-refrigerators, dehumidifiers, and water heaters. Fin-tube heat exchangers, in which heat transfer fins and heat transfer tubes are combined, also are commonly used. A fin-tube heat exchanger is constructed of a plurality of heat transfer fins arranged at a predetermined fin pitch, and heat transfer tubes penetrating these fins.

In this type of heat exchanger, the heat transfer coefficient of the fin increases when the velocity of the fluid flowing over the fin surface is increased. However, as the velocity of the fluid flowing over the fin surface becomes higher, the pressure loss of the fluid that passes through the heat exchanger correspondingly increases. Thus, there is a trade-off between the pressure loss and the heat transfer coefficient in the heat exchanger. In view of this, it has been desired to improve the heat transfer coefficient and at the same time prevent the pressure loss from increasing, in order to enhance the performance of the heat exchanger.

Various fin shape designs for improving the heat transfer coefficient and reducing the pressure loss have been known. For example, JP 64-90995 A discloses a corrugated fin in which a plate-shaped fin is bent in a wave-like shape. JP 7-239196 A discloses a fin-tube heat exchanger in which a large number of very small dimples are provided on the surfaces of the fins. JP 63-294494 A discloses a fin-tube heat exchanger in which projections each having a triangular pyramidal shape are provided on the surfaces of the fins. JP 6-300474 A discloses a fin-tube heat exchanger in which quadrangular pyramidal-shaped protrusions are provided on the surfaces of the fins.

DISCLOSURE OF THE INVENTION

In recent years, however, further enhancements in heat exchanger performance have been desired. Accordingly, it has not always been the case that an attempt to optimize the specification of a conventional fin-tube heat exchanger can result in satisfactory performance. For this reason, a fin-tube heat exchanger that has an entirely novel fin shape has been awaited.

The present invention has been accomplished in view of the foregoing circumstances, and it is an object of the invention to provide a novel fin and a novel fin-tube heat exchanger that can improve the heat transfer coefficient and at the same time prevent the pressure loss from increasing.

According to the present invention, a heat transfer fin includes a protuberance protruding from a surface of the fin, and a cut-out formed upstream of the protuberance in a predetermined direction. The protuberance has, as an upstream portion adjacent to the cut-out, a wing portion tapering toward an upstream side.

It is preferable that the protuberance is a remaining portion after the cut-out is formed in such a manner that the wing portion is formed in an original protuberance that is a substantially elliptical hump or a substantially circular hump protruding from a fin basal plane, and that a tangent plane to an apex of the substantially elliptical hump or the substantially circular hump be parallel to the fin basal plane. A plane containing the principal surface in which the protuberance is not formed may be defined as a fin basal plane of the heat transfer fin.

It should be noted here that the "elliptical hump" refers to a protruding portion such that the contour of its projected image obtained by orthogonal projection onto the fin basal plane is an elliptical shape and that the contour of its vertical cross section containing the apex forms a curved line (such as a sine curve or a cosine curve). On the other hand, the "circular hump" refers to a protruding portion such that the contour of its projected image obtained by orthogonal projection onto the fin basal plane is a circular shape and that the contour of its vertical cross section containing the apex forms a curved line (such as a sine curve or a cosine curve).

The protuberance may be a remaining portion after the cut-out is formed in such a manner that the wing portion is formed in an original protuberance that is a substantially elliptic cone or a substantially polygonal pyramid protruding from a fin basal plane.

Herein, the term "cone" or "pyramid" refer to a shape formed by the linear lines, each of which connects a point on the circumference of a closed curve (or angular line) on a plane (fin basal plane) with a fixed point (apex) outside the plane. The term "elliptic conic shape" refers to one in which the closed curve on the plane forms an ellipse. The term "polygonal pyramid shape" refers to one in which the closed curve on the plane forms a polygon. The term "circular cone" refers to one in which the closed curve on the plane forms a circle.

The protuberance may protrude from a fin basal plane, and the wing portion may be parallel to the fin basal plane. The triangular wing portion may slope so that its upstream side is closer to the fin basal plane. Alternatively, the triangular wing portion may slope so that its upstream side is more distant from the fin basal plane.

The heat transfer fin according to the present invention may be used for a fin-tube heat exchanger for exchanging heat between a first fluid and a second fluid. In this case, a plurality of heat transfer tube through-holes, to which heat transfer tubes for passing the second fluid are to be fitted, may be provided in the heat transfer fin at regular intervals along a predetermined row direction intersecting a flow direction of the first fluid, and further, the protuberance may be provided between two adjacent ones of the heat transfer tube through-holes. The cut-out may be formed along the wing portion of the protuberance so that, when the first fluid flowing along a principal surface of the heat transfer fin reaches the protuberance, the first fluid is allowed to flow from a first principal surface side to a second principal surface side of the heat transfer fin.

A fin-tube heat exchanger according to the present invention includes:

a plurality of heat transfer fins arranged spaced apart from and parallel to each other; and a plurality of heat transfer tubes penetrating the heat transfer fins, the fin-tube heat exchanger being for exchanging heat between a first fluid flowing on surfaces of the heat transfer fins and a second fluid flowing inside the heat transfer tubes, wherein:

the plurality of heat transfer tubes include a first heat transfer tube and a second heat transfer tube, both arranged in a predetermined row direction intersecting a flow direction of the first fluid;

each of the heat transfer fins has a protuberance and a cut-out between the first heat transfer tube and the second heat transfer tube, the protuberance protruding from the surface of the fin and guiding the first fluid toward the first heat transfer tube and toward the second heat transfer tube, and the cut-out being formed upstream of the protuberance with respect to the flow direction of the first fluid; and the protuberance has, as an upstream portion adjacent to the cut-out, a wing portion tapering toward an upstream side.

It is preferable that the heat transfer tubes and the protuberances be arranged in a staggered manner when viewed in an axis direction of the heat transfer tubes, and the protuberances be disposed between respective ones of the heat transfer tubes that are adjacent in the row direction.

In another aspect, the present invention provides a fin-tube heat exchanger for exchanging heat between a first fluid and a second fluid, including:

a plurality of heat transfer fins arranged spaced apart from and parallel to each other so as to form a space for allowing the first fluid to flow therethrough; and a plurality of heat transfer tubes for allowing the second fluid to flow therethrough, the plurality of heat transfer tubes penetrating the plurality of heat transfer fins and arranged in a predetermined row direction intersecting a flow direction of the first fluid, wherein:

each of the heat transfer fins has: (a) a protuberance formed between a first heat transfer tube and a second heat transfer tube that are adjacent with respect to the row direction; and (b) a hole formed along an upstream portion of the protuberance with respect to the flow direction of the first fluid so that, when the first fluid flowing along a principal surface of the heat transfer fin reaches the protuberance, the first fluid is allowed to flow from a first principal surface side to a second principal surface side of the heat transfer fin;

the protuberance and the hole are mirror symmetrical with respect to a mirror plane of symmetry that contains a perpendicular bisector of a line segment, the line segment connecting a center of the first heat transfer tube and a center of the second heat transfer tube at the shortest distance;

a boundary line between the protuberance and the hole, that is observed when the heat transfer fin is viewed in plan, forms a protruding shape toward an upstream side with respect to the flow direction of the first fluid; and the protuberance has, as the upstream portion whose contour is defined by the boundary line, a wing portion whose width along the row direction decreases toward the upstream side with respect to the flow direction of the first fluid.

The present invention makes it possible to improve the heat transfer coefficient of the heat transfer fin and at the same time prevent the pressure loss from increasing. In addition, the present invention makes available a high performance fin-tube heat exchanger that has a novel configuration.

BEST MODE FOR CARRYING OUT THE INVENTION

Hereinbelow, embodiments of the present invention are described in detail with reference to the drawings.

Figure 1:
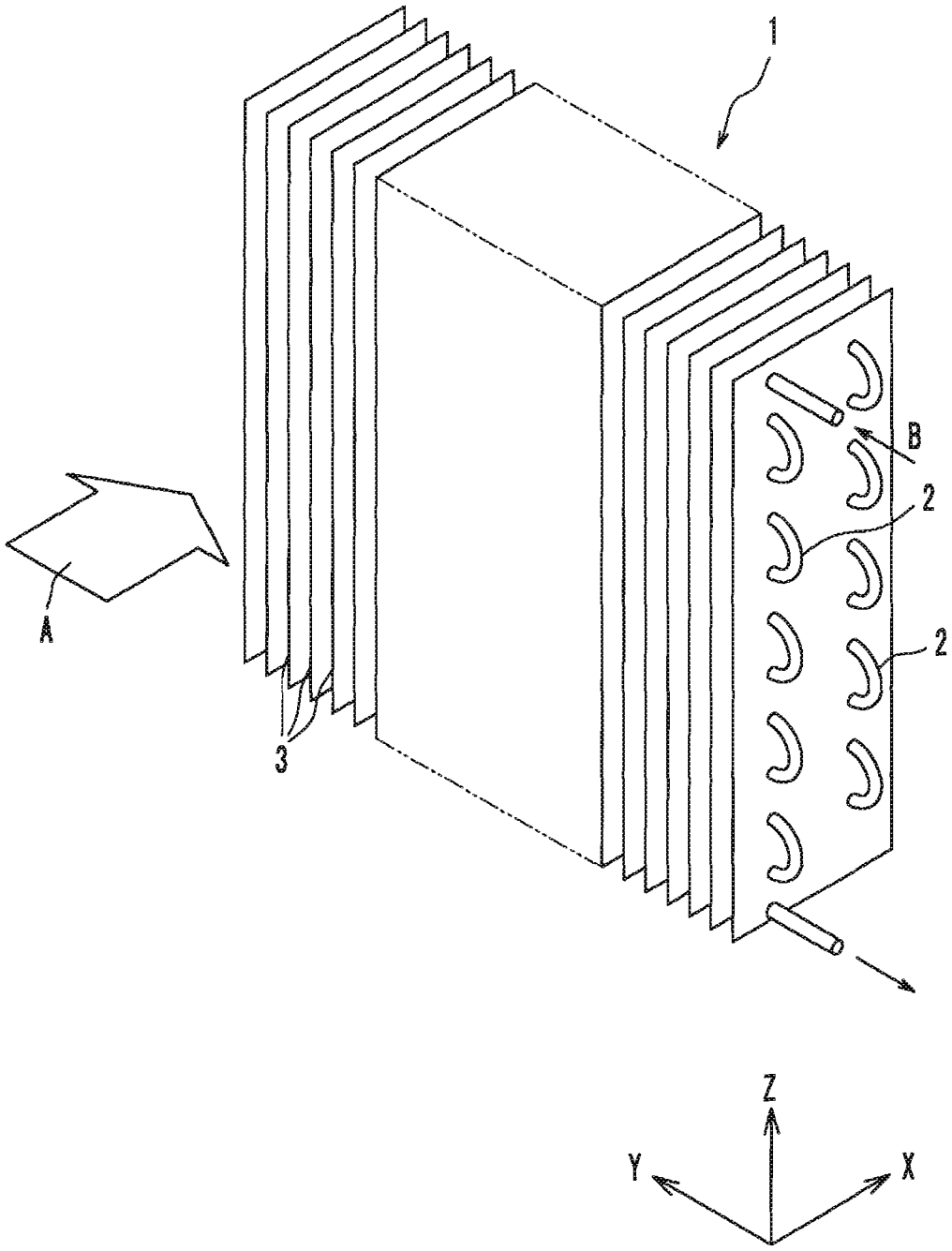
FIG. 1 is a perspective view of a fin-tube heat exchanger.

As illustrated in FIG. 1, a fin-tube heat exchanger 1 according to an embodiment has a plurality of fins 3 arranged at a predetermined spacing and parallel to each other so as to form spaces for allowing air A to pass therethrough, and a plurality of heat transfer tubes 2 penetrating these fins 3. The heat exchanger 1 is for exchanging heat between the fluid flowing inside the heat transfer tubes 2 and the fluid flowing along the surfaces of the fins 3. In the present embodiment, the air A flows along the surfaces of the fins 3, and refrigerant B flows inside the heat transfer tubes 2. It should be noted that the type and state of the fluid that flows inside the heat transfer tubes 2 and those of the fluid that flows along principal surfaces of the fins 3 are not particularly limited. Each of the fluids may be either a gas or a liquid. The plurality of heat transfer tubes 2 may or may not be connected to form a single tube.

Figure 3:
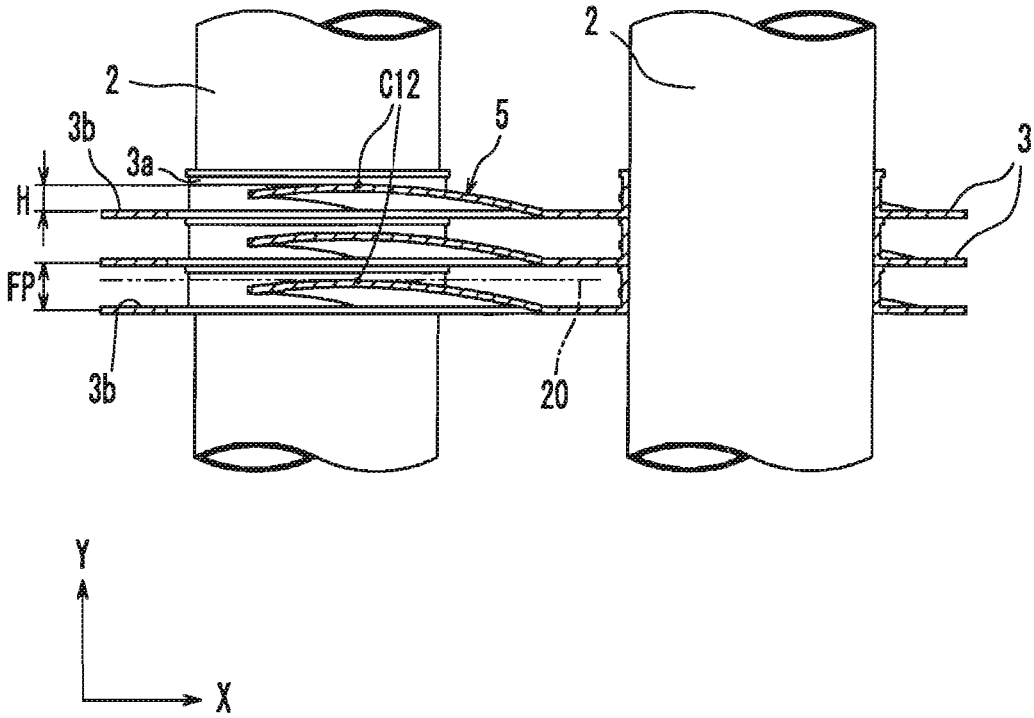
FIG. 3 is a cross-sectional view taken along line III-III in FIG. 2A.

The fins 3 are formed in a substantially flat plate shape having a rectangular shape, and are arranged in the Y direction shown in the figure. In the present embodiment, the fins 3 are arranged at a regular fin pitch. The fin pitch is, for example, from 1.0 mm to 1.5 mm. The fin pitch may not necessarily be uniform, but it may be varied. It should be noted that, as illustrated in FIG. 3, fin pitch FP is defined as the distance between the centers of adjacent ones of the fins 3. An aluminum flat plate having a thickness of 0.08-0.2 mm, made by a punch-out process, for example, may be used suitably as each of the fins 3. It is preferable that the surface of the fin 3 be subjected to a hydrophobic treatment or a hydrophilic treatment, such as a boehmite treatment or coating with a hydrophilic paint.

Figure 2A:
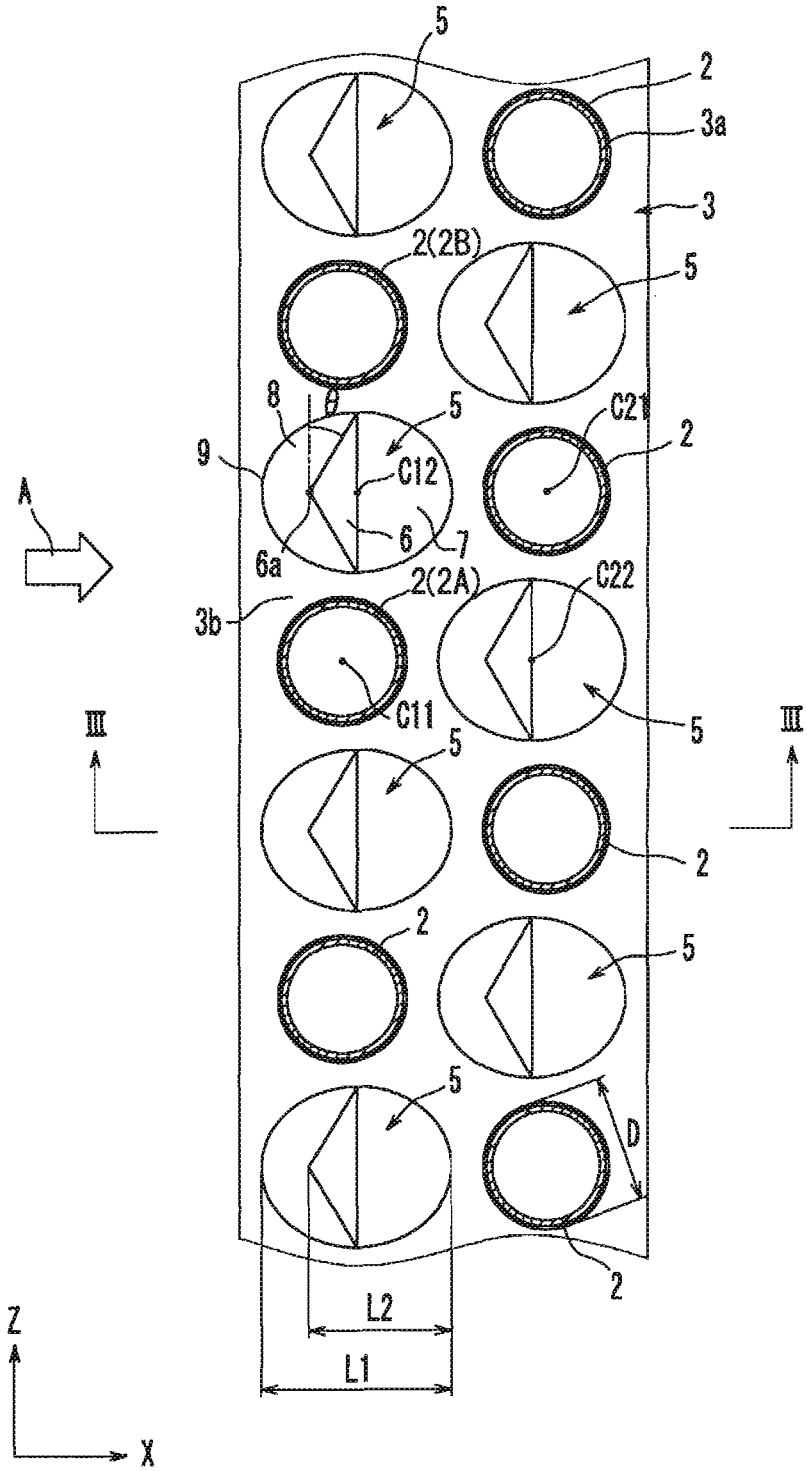
FIG. 2A is a plan view of a fin.

As illustrated in FIG. 2A, two rows of the heat transfer tubes 2 are provided in the present embodiment. The heat transfer tubes 2 in each row are arranged along a longitudinal direction of the fins 3 (hereinafter simply referred to as the "Z direction" or the "row direction"). In each fin 3, a plurality of heat transfer tube through-holes, to which the heat transfer tubes 2 are fitted, are provided at regular intervals along a predetermined row direction that intersects the flow direction of the air A. Fin collars 3*a* are provided around the surrounding regions of the heat transfer tube through-holes. The heat transfer tubes 2 in the first row and the heat transfer tubes 2 in the second row are staggered relative to each other in the Z direction by ½ of the tube pitch. In other words, the heat transfer tubes 2 are arranged in a staggered manner. It should be noted that the tube pitch is represented by the distance between the centers of the heat transfer tubes 2 that are adjacent in the row direction. The outer diameter D of the heat transfer tubes 2 is, for example, from 1-20 mm. The heat transfer tubes 2 are in intimate contact with the fin collars 3*a*, and are fitted in the fin collars 3*a*. Each of the heat transfer tubes 2 may be a smooth tube, the inner surface of which is flat and smooth, or a grooved tube in which grooves are formed in the inner surface thereof.

The heat exchanger 1 is installed in such a position that the flow direction of the air A (X direction in FIG. 1) is approximately perpendicular to the stacking direction of the fins 3 (Y direction) and the row direction of the heat transfer tubes 2 (Z direction). That said, the airflow direction may be inclined slightly from the X direction as long as a sufficient heat exchange amount can be ensured.

A plurality of protuberances 5 are formed in a surface of the fin 3. Each of the protuberances 5 is formed in such a shape that an upstream portion of an elliptical hump, which is elongated in the X direction, is partially cut off. A triangular wing portion 6 tapering toward the upstream side is formed as an upstream portion, with respect to the flow direction of the air A, of each protuberance 5. In other words, each of the protuberances 5 is formed by a rear-half portion 7 in a semi-elliptical hump shape and the triangular wing portion 6 located upstream of the rear-half portion 7. The triangular wing portion 6 of the present embodiment is formed in what is called a delta wing shape having a substantially triangular shape. A hole (cut-out) 8 is formed upstream of the protuberance 5 so as to be adjacent to the protuberance 5.

The hole 8 is formed along the upstream portion 6 (triangular wing portion 6), with respect to the flow direction of the air A, of the protuberance 5 so that, when the air A that flows along the principal surface of the heat transfer fin 3 reaches the protuberance 5, the air A is allowed to flow from a first principal surface side (obverse surface side) to a second principal surface side (reverse surface side) of the heat transfer fin 3.

The protuberance 5 protrudes from one of the surfaces of the fin 3. When one of two heat transfer tubes 2, 2 that are adjacent with respect to the Z direction, which intersects the flow direction of the air A, is defined as a first heat transfer tube 2A and the other one is defined as a second heat transfer tube 2B, only one protuberance 5 is disposed between the first heat transfer tube 2A and the second heat transfer tube 2B. Moreover, in the present embodiment, the protrusions 5 are disposed at the midpoints between the heat transfer tubes 2 that are adjacent in a row direction. More specifically, when viewed in the axis direction of the heat transfer tubes 2, the heat transfer tubes 2 are disposed in a staggered manner, and the protuberances 5 also are disposed in a staggered manner.

Figure 2B:
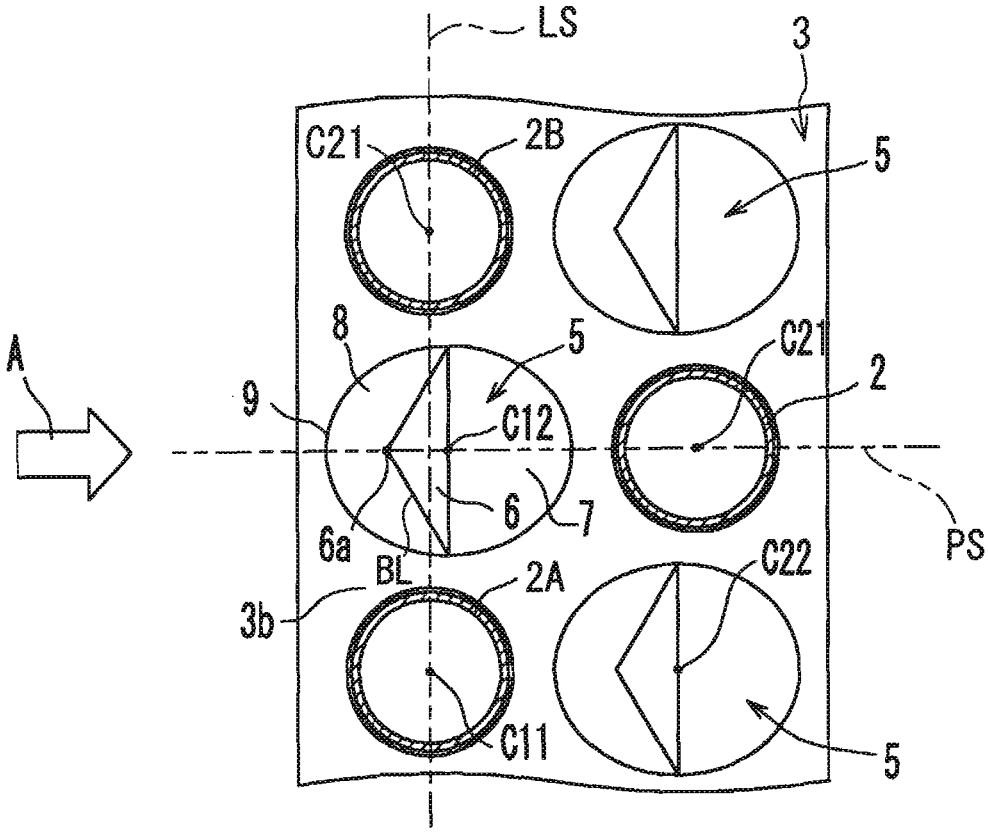
FIG. 2B is a partially enlarged view of FIG. 2A.

As will be appreciated from the partially enlarged view of FIG. 2B, the protuberance 5 and the hole 8 are mirror symmetrical with respect to a mirror plane of symmetry PS containing a perpendicular bisector of a line segment LS connecting a center C11 of the first heat transfer tube 2A and a center C21 of the second heat transfer tube 2B at the shortest distance. A boundary line BL between the protuberance 5 and the hole 8, which is observed when the fin 3 is viewed in plan, forms a protruding shape toward an upstream side with respect to the flow direction of the air A. Each of the protuberances 5 has, as the upstream portion 6 whose contour is defined by the boundary line BL, the wing portion 6 whose width along the row direction (Z direction) decreases toward the upstream side of the flow direction of the air A.

Figure 6:
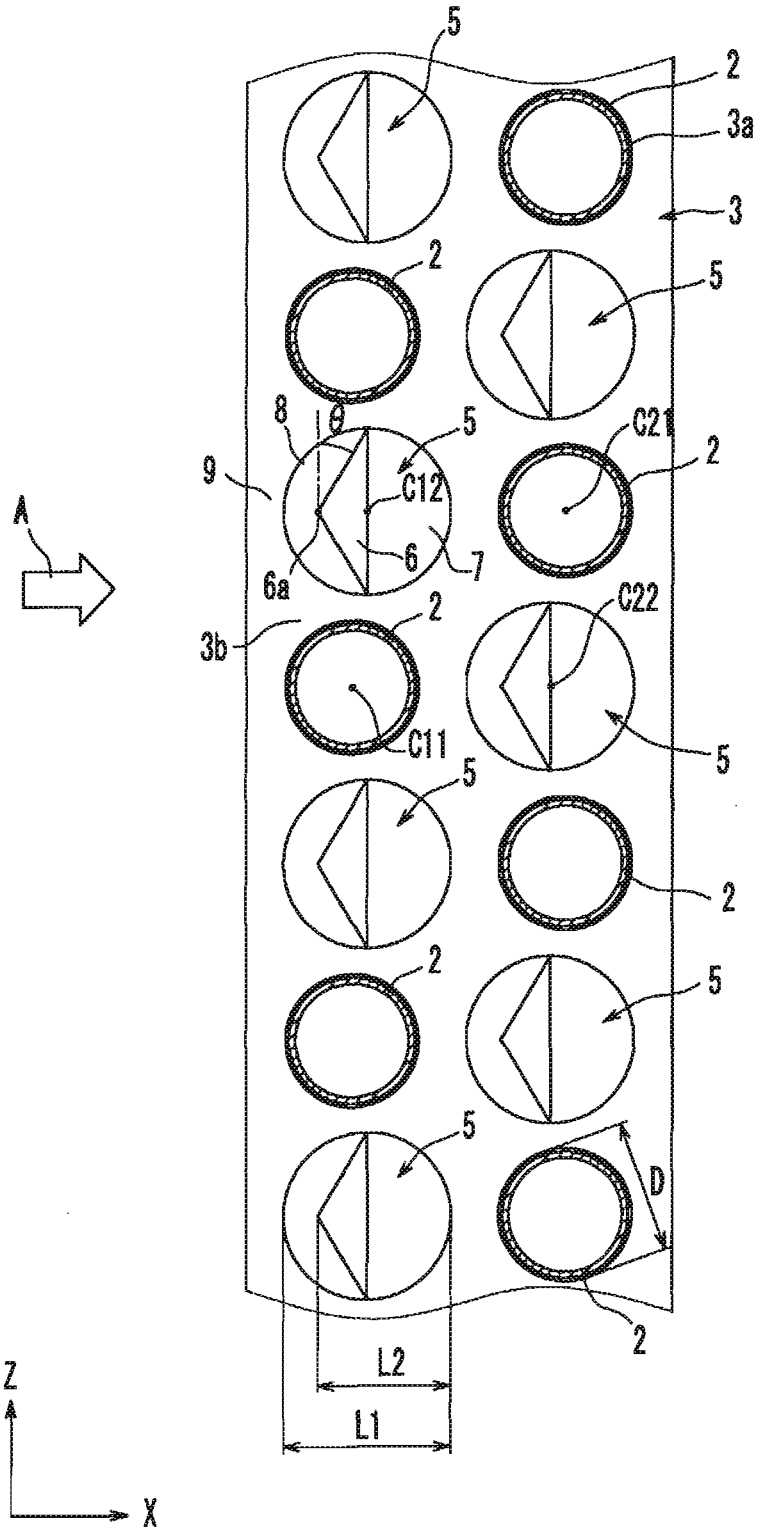
FIG. 6 is a plan view of a fin according to a modified example.

The protuberance 5 is a remaining portion of an original protuberance that is a substantially elliptical hump protruding from a fin basal plane, after the hole 9 (cut-out) is formed in the original protuberance in such a manner that the wing portion 6 is formed therein. In other words, the planer image of the protuberance 5 and the hole 8 as a whole shows an elliptical shape. The major axis of the ellipse corresponds to the X direction, and the minor axis thereof corresponds to the Z direction. In later-described other examples (see FIGS. 6 and 7), the planar image of the protuberance 5 and the hole 8 shows a circular shape or a polygonal shape.

The area of the projected image of the elliptical hump 9, which becomes the foundation of the protuberance 5 (i.e., the original protuberance in which the cut-out has not yet been formed), onto the fin basal plane is set to be equal to or greater than the area of the heat transfer tube 2. In other words, the equivalent diameter d (the equivalent diameter d being defined by the equation $\pi d^2/4=S$ (area)) of the elliptical hump 9 is equal to or greater than the outer diameter D of the heat transfer tubes 2. In the present embodiment, the longer axis of the projected image of the elliptical hump 9 is greater than the outer diameter D of the heat transfer tube 2, and the shorter axis thereof is also greater than the outer diameter D of the heat transfer tube 2. It should be noted that reference character L1 indicates the airflow-wise length (the length along the X direction) of the elliptical hump 9, and reference character L2 indicates the airflow-wise length of the protuberance 5. The fin basal plane refers to a plane containing the principal surface in which the protuberances 5 are not formed.

The center (apex) C12 of each of the elliptical humps 9 in the first row is located downstream of the center C11 of each of the heat transfer tubes 2 in the first row. On the other hand, the upstream edge 6*a* of each of the protuberances 5 in the first row is located upstream of the center C11 of each of the heat transfer tubes 2 in the first row. The center (apex) C22 of each of the elliptical humps 9 in the second row is located upstream of the center C21 of each of the heat transfer tubes 2 in the second row. The elliptical humps 9 in the first row and the elliptical humps 9 in the second row partially overlap with each other, when viewed in the Z direction. The protuberance 5 and the heat transfer tube 2 that are adjacent in the X direction are disposed at the same position with respect to the Z direction. Specifically, the center C12 of each of the elliptical humps 9 in the first row and the center C21 of each of the heat transfer tubes 2 in the second row are located at the same position with respect to the Z direction. Likewise, the center C11 of each of the heat transfer tubes 2 in the first row and the center (apex) C22 of each of the protuberances 5 in the second row are located at the same position with respect to the Z direction.

Thus, a portion or the entirety of the wing portion 6 is located upstream of the linear line that passes through the center C11 of the first heat transfer tube 2A and the center C21 of the second heat transfer tube 2B, with respect to the flow direction of the air A. Since the wing portion 6 is disposed in such a position, the air A can be guided to the first heat transfer tube 2A and the second heat transfer tube 2B efficiently.

In the plan view of the fin 3 shown in FIG. 2A, an angle formed by one side of the triangular wing portion 6 and the linear line parallel to the Z direction (row direction) and passing through the upstream edge 6*a* of the triangular wing portion 6 is defined as a sweepback angle θ. The size (area) of the triangular wing portion 6 can be adjusted by appropriately changing the sweepback angle θ. The value of the sweepback angle θ preferably may be, but is not particularly limited to, from 30 degrees to 50 degrees. In the present embodiment, it is set at about 30 degrees. In the present embodiment, the leading edge of the triangular wing portion 6 is formed linearly. However, the leading edge of the triangular wing portion 6 may be formed in a curved line. The wing portion may not have a triangular shape, but may be other polygonal shapes, for example.

As illustrated in FIG. 3, the height H of the protuberance 5 measured from the fin basal plane 3*b* to the apex C12 (hereinafter simply referred to as "the height of the protuberance 5") is less than the fin pitch FP. The value of the height H of the protuberance 5 may be, but is not particularly limited to, ⅓ to ⅔ of the fin pitch FP, for example. In the present embodiment, the height H of the protuberance 5 is set at about ⅔ of the fin pitch FP.

Figure 4:
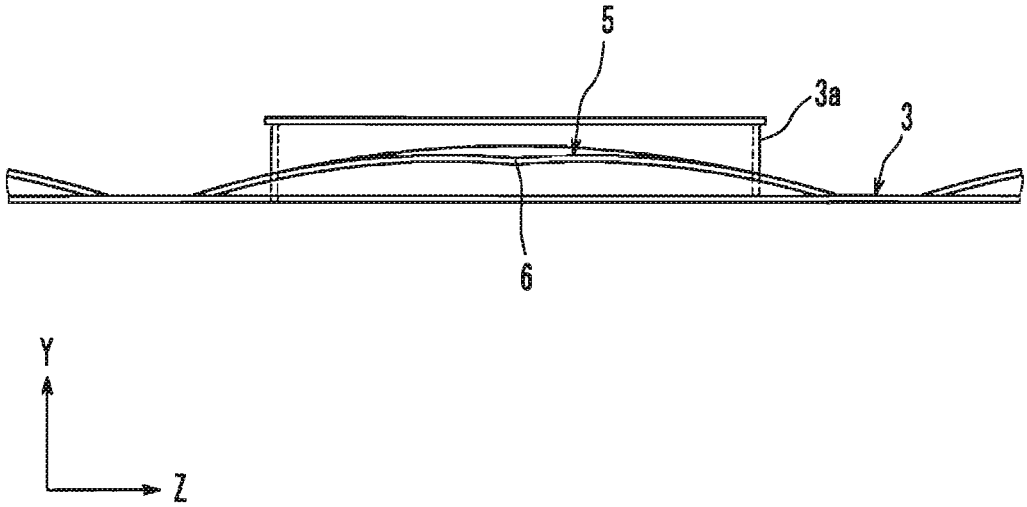
FIG. 4 is a front view of a portion of the fin, viewed from the upstream side.

As illustrated in FIG. 3, and in FIG. 4, which is a view of the fin 3 viewed in the X direction, the triangular wing portion 6 slopes so that the distance between the triangular wing portion 6 and the fin basal plane 3*b* decreases toward the upstream side. In other words, the triangular wing portion 6 is formed in what is called a "head-down" condition.

A tangent plane 20 to the apex C12 of the protuberance 5 is parallel to the fin basal plane 3*b*. Thus, the protuberances 5 are formed in a harmonious shape with the fin basal plane 3*b* so as not to disturb the flow of the air needlessly.

Next, the flow of the air in the present heat exchanger 1 will be discussed.

Figure 5:
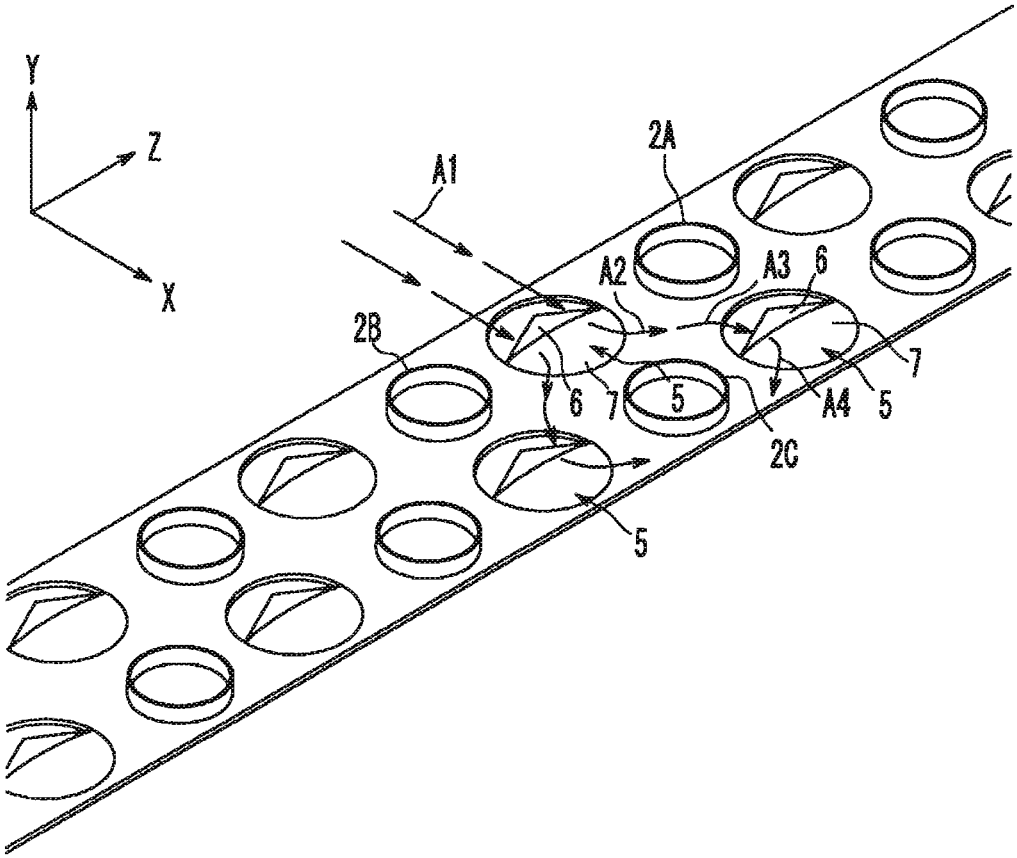
FIG. 5 is a perspective view of the fin, illustrating the flow of air.

As illustrated in FIG. 5, airflow A1 coming from the front of the fin 3 collides against the triangular wing portion 6. At this time, a thin thermal boundary layer forms over the surface of the triangular wing portion 6 due to what is called the leading edge effect. As a result, the heat transfer coefficient is improved by the triangular wing portion 6. Meanwhile, the perpendicular component of airflow (the component perpendicular to the leading edge of the triangular wing portion 6) is made smaller by the triangular wing portion 6, so the pressure loss is reduced.

Airflow A2 that has flowed over the triangular wing portion 6 subsequently flows over the rear-half portion 7 located downstream of the triangular wing portion 6. Since the triangular wing portion 6 is formed so as to divide the airflow and also the rear-half portion 7 is formed in a semi-elliptical hump shape, the airflow A2 is guided to the right and to the left by the protuberance 5. Accordingly, part of the airflow A2 is guided toward the heat transfer tube 2A side, while the other airflow A2 is guided toward the heat transfer tube 2B side. Then, the airflow A2 guided toward the heat transfer tube 2A side flows around to the rear of the heat transfer tube 2A. Likewise, the airflow A2 guided toward the heat transfer tube 2B side flows around to the rear of the heat transfer tube 2B. As a result, in a portion of the fin 3 at the rear of the heat transfer tubes 2A and 2B, the dead fluid zone is made smaller and the heat transfer coefficient is hindered from degrading.

Next, airflow A3 that has flowed around to the rear of the heat transfer tube 2A collides against the protuberance 5 in the second row. Then, by the triangular wing portion 6, the heat transfer coefficient is improved due to the leading edge effect and the pressure loss is reduced, as in the foregoing. Airflow A4 that has flowed over the triangular wing portion 6 of the protuberance 5 in the second row then flows over the rear-half portion 7 of that protuberance 5. Thereby, part of the airflow A4 is guided along the semi-elliptical hump shape of the rear-half portion 7 toward the heat transfer tube 2C side to flow around to the rear of the heat transfer tube 2C. As a result, the dead fluid zone is made smaller and the heat transfer coefficient is hindered from degrading also at the rear of the heat transfer tube 2C.

In the present embodiment, after the air is divided by the triangular wing portion 6 toward the one heat transfer tube 2A side and toward the other heat transfer tube 2B side, the flow of the air is accelerated in the space between the rear-half portion 7 of the protuberance 5 and each of the heat transfer tubes 2A and 2B. Therefore, the heat transfer coefficient of the fin 3 improves corresponding to the acceleration of the air.

In addition, the accelerated air collides against the protuberance 5 provided downstream. As a result, the thermal boundary layer becomes thinner at the triangular wing portion 6 of the downstream protuberance 5. Accordingly, the heat transfer coefficient at the protuberance 5 of the more downstream side improves, leading to an improvement in the heat transfer coefficient of the fin 3 as a whole.

In addition, in the present heat exchanger 1, only one protuberance 5 is formed between the first heat transfer tube 2A and the second heat transfer tube 2B. The equivalent diameter d of the projected image of the elliptical hump 9 (original protuberance), which becomes the foundation of the protuberance 5, is equal to or greater than the outer diameter D of the heat transfer tube 2, which means that each protuberance 5 is formed to be relatively large. Therefore, the flow direction can be changed at a relatively large extent. Accordingly, it is possible to guide the air to the rear of the heat transfer tubes 2 desirably even when the flow velocity of the air is relatively small (for example, when the front velocity is less than 2 m/s), or even when it is particularly small (for example, when the front velocity is less than 1 m/s). The present heat exchanger 1 can exhibit good heat transfer characteristics even for the airflow in a laminar flow condition.

Moreover, since the holes 8 are formed upstream of the protuberances 5, the amount of heat transfer from the leading most edge portion of the heat transfer fin 3 to the heat transfer tubes 2 is restricted to an appropriate degree. As a result, the heat transfer coefficient of the leading most edge portion of the heat transfer fin 3 is not likely to become locally high. Therefore, it is possible to expect the effect of preventing frost formation on the leading most edge portion of the heat transfer fin 3, when the present heat exchanger 1 is used as an evaporator. Furthermore, the degradation in heat transfer performance resulting from the decrease in the heat transfer coefficient of the leading most edge portion of the heat transfer fin 3 can be compensated by the improvement in the heat transfer performance because of the protuberances 5. In addition, even when frost formation occurs on the leading edge portion of the tapered wing portion 6, part of the air A can pass through the holes 8. Therefore, pressure loss can be minimized.

It should be noted that the shape of the elliptical hump 9 (original protuberance), which becomes the foundation of the protuberance 5, may be such a shape that its contour forms a sine curve or a cosine curve when the elliptical hump 9 is cut along the cross section perpendicular to the Z direction. In other words, the contour of the elliptical hump 9 cut along the just-mentioned cross section may be a cosine curve represented by the equation $y=K\cos(x)$, where K is a constant. Here, x is a variable in the range $-180° \leqq x \leqq 180°$.

Figure 7:
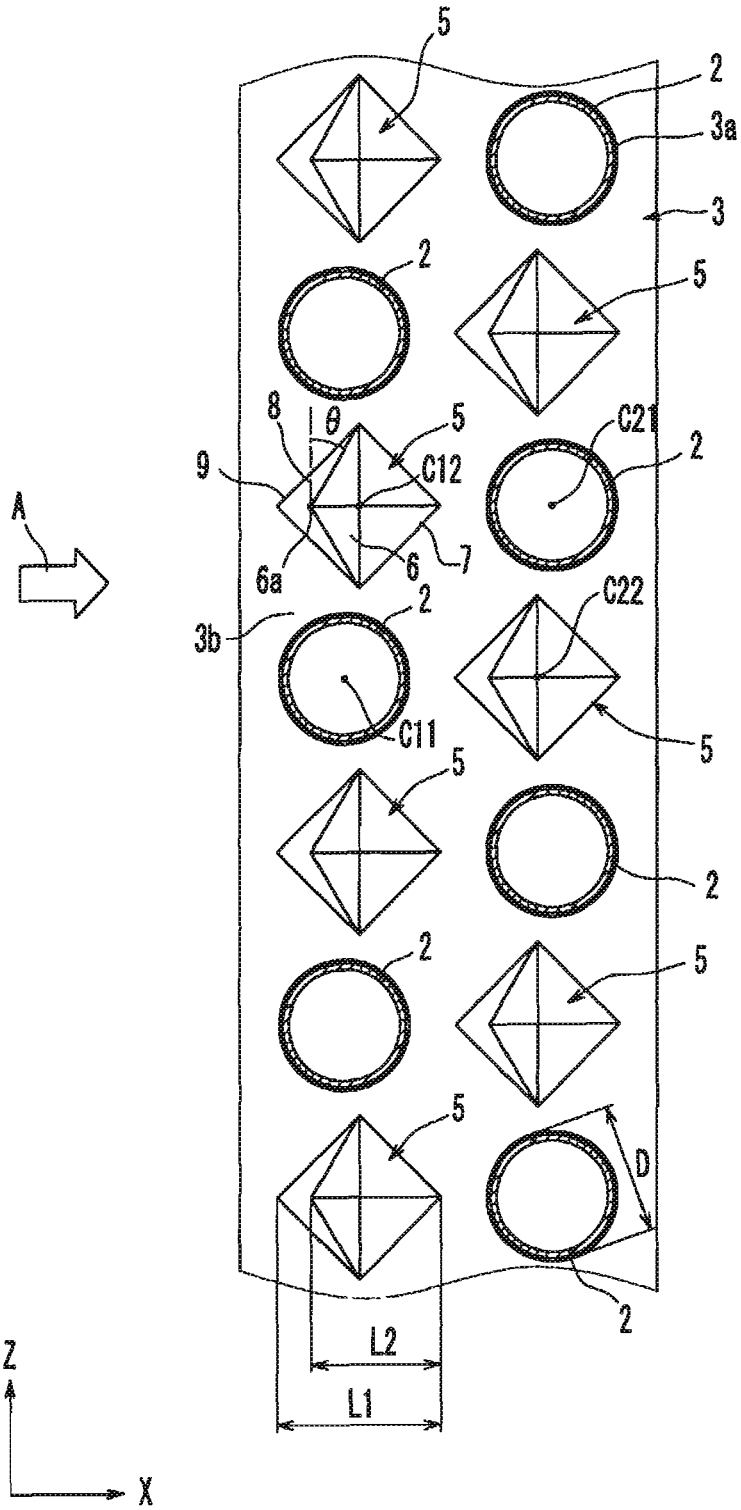
FIG. 7 is a plan view of a fin according to a modified example.

The shape of the original protuberance, which becomes the foundation of the protuberance 5, is not limited to the elliptical hump, but may be a circular hump (see FIG. 6) or a polygonal pyramid (see FIG. 7, which shows a quadrangular pyramid as one example of the polygonal pyramid). It also may be a circular cone, an elliptic cone, or the like. When employing a shape with a sharp-pointed apex, such as a circular cone or an elliptic cone, even better heat transfer characteristics can be obtained. On the other hand, when employing a shape with a gentle apex, such as a circular hump or an elliptical hump, the manufacturing becomes easier.

Next, a method of manufacturing the above-described fin 3 will be described below. To manufacture the fin 3, first, a mold for stamping out the triangular wing portions 6 is prepared in advance, and the mold is pressed against a fin material in a flat plate shape to carry out a pressing process. As a result, portions of the fin material are stamped out to form triangular wing portions 6 in a state before protruding. Next, a mold (also prepared in advance) for the elliptical humps 9, which become the foundation of the protuberances 5, is positioned at a predetermined position, and thereafter pressed against the above-mentioned fin material. As a result, downstream portions of the stamped-out portions are partially elevated in an substantially elliptical hump shape, whereby the protuberances 5 (the triangular wing portions 6 and the rear-half portions 7) are formed.

The foregoing fin-tube heat exchanger 1 is manufactured in the following manner. Specifically, in the fin 3 manufactured in the above-described manner, holes are provided at predetermined positions at which the heat transfer tubes 2 penetrate, and the surrounding regions of the holes are elevated to form fin collars 3*a*. Next, a predetermined number of the fins 3 are arranged at a predetermined fin pitch, and the heat transfer tubes 2 are inserted to the holes. Then, the heat transfer tubes 2 and the fins 3 are joined (for example, by tube-expanding joining). Thereby, the foregoing fin-tube heat exchanger 1 is manufactured.

It should be noted that all of the above-described methods of manufacturing the fin 3 and the fin-tube heat exchanger 1 are merely illustrative examples, and the manufacturing methods therefor are not limited to the above-described methods.

Figure 8:
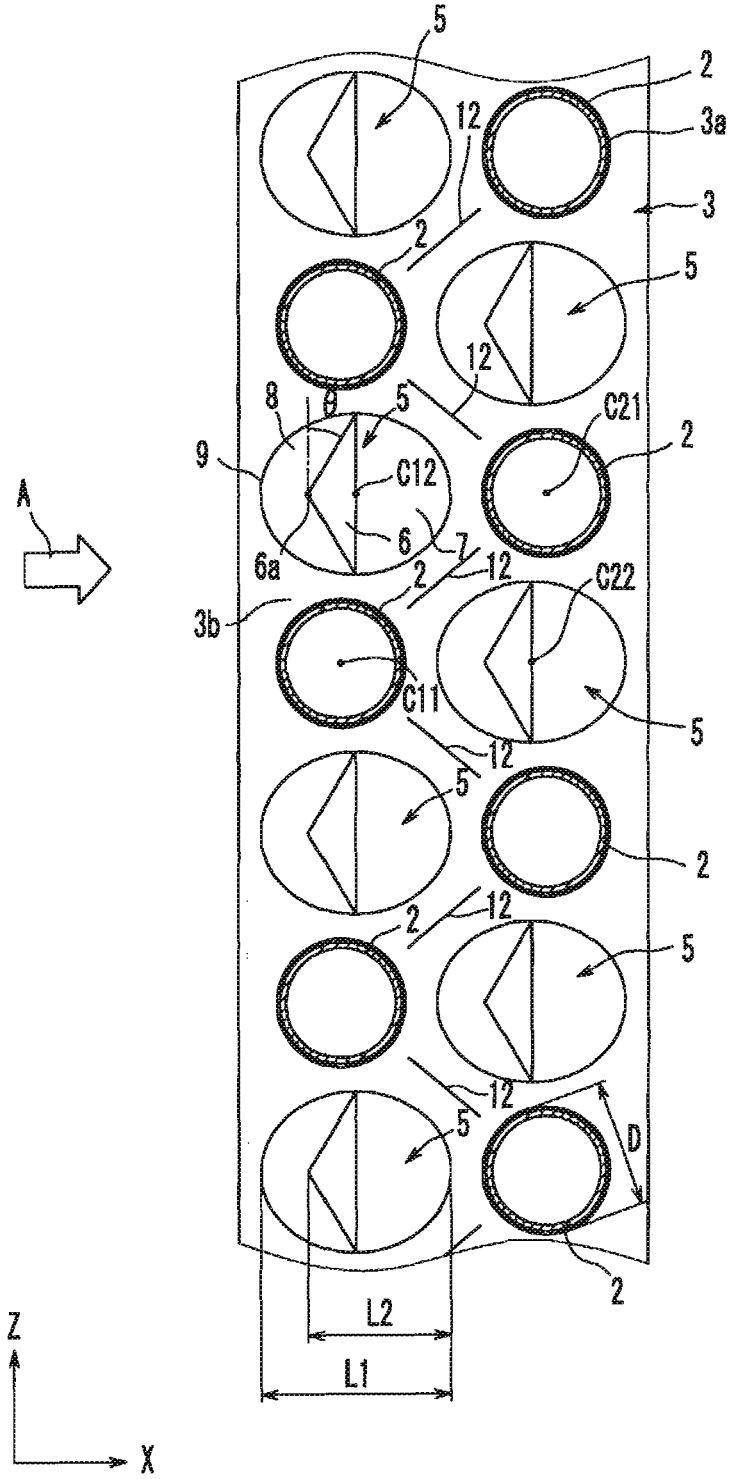
FIG. 8 is a plan view of a fin according to a modified example.

When the thickness of the fin 3 is small or the size of the protuberances 5 is large, there is a risk that, when producing the protuberances 5, a twist may occur in the fin material or unintentional irregularities may form in the surface of the fin material. In view of this, slits 12 may be provided in advance in the fin material as illustrated in FIG. 8 so that such twists or irregularities can be absorbed. It is preferable that the slits 12 be formed between (particularly at the midpoint between) the protuberances 5 adjacent to each other in a diagonal direction. In addition, it is preferable that the slits 12 extend in directions perpendicular to the lines connecting the apexes of the protuberances 5. By providing the slits 12 in the fin material in this way, excessive stress is not likely to occur when the mold is pressed against the fin material, so it becomes easier to form the protuberances 5 with an appropriate shape and an appropriate size.

Figure 9:
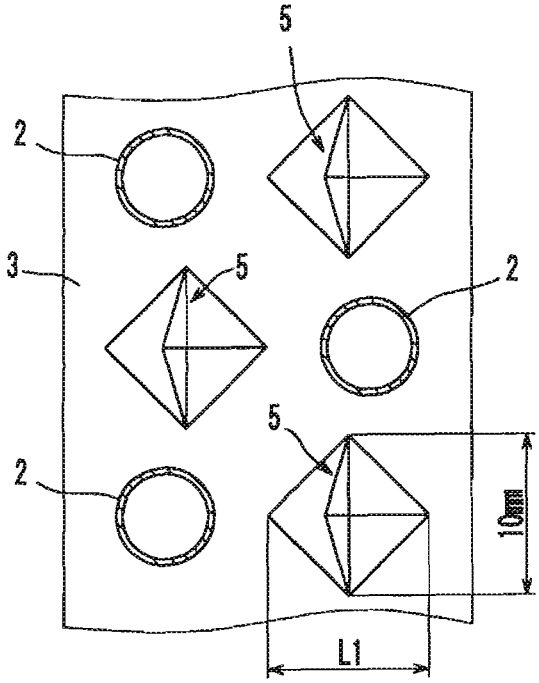
FIG. 9 is a plan view of a simulation model.

Table 1 shows simulation results in which the fin-tube heat exchangers according to the present embodiment (see FIG. 9 for the specific configuration) are compared with a fin-tube heat exchanger having a conventional corrugated fin (a fin bent in a wave-like form; for example, see FIGS. 1 and 2 in JP 64-90995 A). In this simulation, the thickness of the fin was set at 0.1 mm, the fin pitch was 1.49 mm, the outer diameter of the heat transfer tubes was 7.0 mm, and the front velocity Vair was 1 m/s.

TABLE 1

| | | | | | (Ratio to corrugated fin) | |
|---|---|---|---|---|---|---|
| | Fin No. | Vair (m/s) | H (mm) | L (mm) | α (%) | ΔP (%) |
| Corrugated fin (Conventional) | No. 1 | 1 | | | 100 | 100 |
| Elliptical hump | No. 2 | 1 | 0.765 | 13 | 108.1 | 84.8 |
| Circular hump | No. 3 | 1 | 1.49 | 10 | 107.6 | 91.2 |
| Circular cone | No. 4 | 1 | 0.765 | 13 | 106.3 | 83.3 |
| | No. 5 | 1 | 1.49 | 13 | 108.6 | 86.8 |
| Quadrangular pyramid | No. 6 | 1 | 0.765 | 13 | 103.8 | 89.0 |

Here, "Elliptical hump," "Circular hump," "Circular cone," and "Quadrangular pyramid" in the fin types represent the shapes of the original protuberances, which become the foundation of the protuberances 5. In Table 1, "Circular hump" and "Elliptical hump" denote the ones in which their contours form a sine curve and a cosine curve, respectively, when cut off along the cross section perpendicular to the Z direction.

As will be appreciated from Table 1, the fin-tube heat exchangers according to the present embodiment achieve lower pressure loss and higher heat transfer coefficients than the conventional fin-tube heat exchanger having a corrugated fin.

As described above, each of the fins 3 of the fin-tube heat exchanger 1 according to the present embodiment has the protuberances 5 and the holes 8 (cut-outs) formed upstream of the protuberances 5, and each of the protuberances 5 has, as an upstream portion adjacent to the hole 8 (cut-out), the triangular wing portion 6 tapering toward an upstream side. Therefore, an improvement in heat transfer coefficient due to the leading edge effect and a reduction in pressure loss due to the decreasing of the perpendicular component of airflow are achieved by the triangular wing portions 6. Moreover, it is possible to guide the airflow to the rear of the heat transfer tubes 2 by the protuberances 5, and to improve the heat transfer coefficient at the rear of the heat transfer tubes 2. Thus, the fin-tube heat exchanger 1 according to the present embodiment makes it possible to prevent the pressure loss from increasing and at the same time improve the heat transfer coefficient. It should be noted that although the original protuberances, which become the foundation of the protuberances 5, are formed in a substantially elliptical hump shape in the present embodiment, substantially the same advantageous effects can be obtained even when the original protuberances are formed in a substantially elliptic conic shape.

In the foregoing embodiment, each of the triangular wing portions 6 slopes so that its upstream side is closer to the fin basal plane 3*b*. Thereby, the flow velocity of the airflow A1 flowing over the upper face (the plus direction along the Y axis in FIG. 5) of the fin 3 is accelerated, and the effect of improving the heat transfer coefficient is obtained.

However, the triangular wing portions 6 may be parallel to the fin basal plane 3*b*. In other words, the line segment connecting the most upstream edge 6*a* of the triangular wing portion 6 and the apex C12 of the protuberance 5 may be parallel to the fin basal plane 3*b*. In such a case, the effect of reducing the pressure loss can be obtained because the airflow A1 passing over the triangular wing portion 6 flows smoothly.

Alternatively, each of the triangular wing portions 6 may slope so that its upstream side is more distant from the fin basal plane 3*b*. In such a case, the flow velocity of the airflow A1 flowing over the back surface (the minus direction along the Y axis in FIG. 5) of the fin 3 is accelerated, and the effect of improving the heat transfer coefficient is obtained.

In the present embodiment, the triangular wing portions 6 are formed for both the protuberances 5 in the first row and the protuberances 5 in the second row. However, the triangular wing portions 6 may be formed for only one of the protuberances 5 in the first row and the protuberances 5 in the second row. In other words, the other one of the protuberances 5 may be the original protuberances in an elliptical hump shape or the like, as they are, before the holes (cut-outs) are not yet formed. The triangular wing portion 6 may not be formed for some of the plurality of protuberances 5 arranged in a row direction. In other words, a protuberance 5 having a triangular wing portion 6 and a protuberance having no triangular wing portion 6 (i.e., an original protuberance) may be arranged adjacent to each other in a row direction.

The present embodiment is an embodiment in which the fin 3 is utilized as a heat transfer fin for the fin-tube heat exchanger 1. However, the applications of the fin according to the present invention are not limited to the fin-tube heat exchanger, but may be other types of heat exchangers, radiators, and condensers.

INDUSTRIAL APPLICABILITY

As has been described above, the present invention is useful for heat transfer fins and fin-tube heat exchangers provided with the fins, as well as various apparatuses provided with the fins and the heat exchangers, such as heat pump systems, hot water heaters using the systems, home or automobile air conditioners, and refrigerators.

The invention claimed is:

1. A heat transfer fin for use in a fin-tube heat exchanger for exchanging heat between a first fluid and a second fluid, comprising:

a plurality of heat transfer tube through-holes to which heat transfer tubes for passing the second fluid are to be fitted, the plurality of heat transfer tube through-holes being provided at regular intervals along a predetermined row direction intersecting a flow direction of the first fluid;

a protuberance protruding from a surface of the fin, the protuberance being provided between two adjacent ones of the heat transfer tube through-holes; and a cut-out formed upstream of the protuberance in the flow direction of the first fluid, wherein:

the protuberance has, as an upstream portion adjacent to the cut-out, a wing portion tapering toward an upstream side;

each through-hole of the plurality of heat transfer tube through-holes is a through-hole that is formed at a position immediately adjacent to a leading edge portion of the heat transfer fin; and a portion or an entirety of the wing portion is located upstream of a line passing through respective centers of the plurality of heat transfer tube through-holes, with respect to the flow direction of the first fluid.

2. The heat transfer fin according to claim 1, wherein:

the protuberance is a remaining portion after the cut-out is formed in such a manner that the wing portion is formed in an original protuberance that is a substantially elliptical hump or a substantially circular hump protruding from a fin basal plane; and a tangent plane to an apex of the substantially elliptical hump or the substantially circular hump is parallel to the fin basal plane.

3. The heat transfer fin according to claim 1, wherein the protuberance is a remaining portion after the cut-out is formed in such a manner that the wing portion is formed in an original protuberance that is a substantially elliptic cone protruding from a fin basal plane.

4. The heat transfer fin according to claim 1, wherein the protuberance is a remaining portion after the cut-out is formed in such a manner that the wing portion is formed in an original protuberance that is a substantially polygonal pyramid protruding from a fin basal plane.

5. The heat transfer fin according to claim 1, wherein:

the protuberance protrudes from a fin basal plane; and the wing portion is parallel to the fin basal plane.

6. The heat transfer fin according to claim 1, wherein:

the protuberance protrudes from a fin basal plane; and the wing portion slopes so that its upstream side is closer to the fin basal plane than its downstream side.

7. The heat transfer fin according to claim 1, wherein:

the protuberance protrudes from a fin basal plane; and the wing portion slopes so that its upstream side is more distant from the fin basal plane than its downstream side.

8. The heat transfer fin according to claim 1, wherein the cut-out is formed along the wing portion of the protuberance so that, when the first fluid flowing along a principal surface of the heat transfer fin reaches the protuberance, the first fluid is allowed to flow from a first principal surface side to a second principal surface side of the heat transfer fin.

9. A fin-tube heat exchanger comprising:

a plurality of heat transfer fins arranged spaced apart from and parallel to each other; and a plurality of heat transfer tubes penetrating the heat transfer fins, the fin-tube heat exchanger being for exchanging heat between a first fluid flowing on surfaces of the heat transfer fins and a second fluid flowing inside the heat transfer tubes, wherein:

the plurality of heat transfer tubes include a first heat transfer tube and a second heat transfer tube, both arranged in a predetermined row direction intersecting a flow direction of the first fluid;

each of the heat transfer fins has a protuberance and a cut-out between the first heat transfer tube and the second heat transfer tube, the protuberance protruding from the surface of the fin and guiding the first fluid toward the first heat transfer tube and toward the second heat transfer tube, and the cut-out being formed upstream of the protuberance with respect to the flow direction of the first fluid;

each protuberance has, as an upstream portion adjacent to the cut-out, a wing portion tapering toward an upstream side, each heat transfer tube is a heat transfer tube that is located at a position immediately adjacent to a leading edge portion of the heat transfer fin; and a portion or an entirety of the wing portion is located upstream of a line passing through the center of the first heat transfer tube and the center of the second heat transfer tube, with respect to the flow direction of the first fluid.

10. The fin-tube heat exchanger according to claim 9, wherein:

the heat transfer tubes and the protuberances are arranged in a staggered manner when viewed in an axis direction of the heat transfer tubes; and the protuberances are disposed between respective ones of the heat transfer tubes that are adjacent in the row direction.

11. A fin-tube heat exchanger for exchanging heat between a first fluid and a second fluid, comprising:

a plurality of heat transfer fins arranged spaced apart from and parallel to each other so as to form a space for allowing the first fluid to flow therethrough; and a plurality of heat transfer tubes for allowing the second fluid to flow therethrough, the plurality of heat transfer tubes penetrating the plurality of heat transfer fins and arranged in a predetermined row direction intersecting a flow direction of the first fluid, wherein:

each of the heat transfer fins has: (a) a protuberance formed between a first heat transfer tube and a second heat transfer tube that are adjacent with respect to the row direction; and (b) a hole formed along an upstream portion of the protuberance with respect to the flow direction of the first fluid so that, when the first fluid flowing along a principal surface of the heat transfer fin reaches the protuberance, the first fluid is allowed to flow from a first principal surface side to a second principal surface side of the heat transfer fin;

the protuberance and the hole are mirror symmetrical with respect to a mirror plane of symmetry that contains a perpendicular bisector of a line segment, the line segment connecting a center of the first heat transfer tube and a center of the second heat transfer tube at the shortest distance;

a boundary line between the protuberance and the hole, that is observed when the heat transfer fin is viewed in plan, forms a protruding shape toward an upstream side with respect to the flow direction of the first fluid;

each protuberance has, as the upstream portion whose contour is defined by the boundary line, a wing portion whose width along the row direction decreases toward the upstream side with respect to the flow direction of the first fluid, each heat transfer tube is a heat transfer tube that is located at a position immediately adjacent to a leading edge portion of the heat transfer fin; and a portion or an entirety of the wing portion is located upstream of a line passing through the center of the first heat transfer tube and the center of the second heat transfer tube, with respect to the flow direction of the first fluid.

12. The fin-tube heat exchanger according to claim 11, wherein only one protuberance is formed between the first heat transfer tube and the second heat transfer tube.

13. The fin-tube heat exchanger according to claim 11, wherein a planar image of the protuberance and the hole as a whole shows an elliptical shape, a circular shape, or a polygonal shape.

14. The heat transfer fin according to claim 1, wherein:

when the plurality of heat transfer tube through-holes are defined as a plurality of first row heat transfer tube through-holes, the protuberance is defined as a first row protuberance, and a distance between centers of two of the first row heat transfer tube through-holes that are adjacent in the row direction is defined as a tube pitch, the heat transfer fin further comprises a plurality of second row heat transfer tube through-holes to which the heat transfer tubes in a second row for passing the second fluid are to be fitted, the plurality of second row heat transfer tube through-holes being provided at regular intervals along the row direction;

a second row protuberance protruding from a surface of the fin, the second row protuberance being provided between two adjacent ones of the second row heat transfer tube through-holes; and a cut-out formed upstream of the second row protuberance in the flow direction of the first fluid;

the plurality of first row heat transfer tube through-holes and the plurality of second row heat transfer tube through-holes are staggered relative to each other in the row direction by ½ of the tube pitch;

the second row protuberance further comprises a wing portion tapering toward an upstream side as an upstream portion adjacent to the cut-out; and a portion or an entirety of the wing portion of the second row protuberance is located upstream of a line passing through respective centers of the plurality of second row heat transfer tube through-holes, with respect to the first fluid.

15. The heat transfer fin according to claim 14, wherein in:

each of the first and second row protuberances is a remaining portion after the cut-out is formed in such a manner that the wing portion is formed in a hump protruding from a fin basal plane before forming of the cut-out; and the hump that becomes a foundation of the first row protuberance and the hump that becomes a foundation of the second row protuberance partially overlap with each other, when viewed in the row direction.

16. The fin-tube heat exchanger according to claim 9, wherein:

when the plurality of heat transfer tubes are defined as a plurality of first row heat transfer tubes, the protuberance is defined as a first row protuberance, and a distance between centers of two of the first row heat transfer tubes that are adjacent in the row direction is defined as a tube pitch, the fin-tube heat exchanger further comprises a plurality of second row heat transfer tubes for passing the second fluid, the plurality of second row heat transfer tubes penetrating the plurality of heat transfer fins and being arranged in the row direction;

a second row protuberance protruding from a surface of the fin, the second row protuberance being provided between two adjacent ones of the second row heat transfer tubes; and a cut-out formed upstream of the second row protuberance in the flow direction of the first fluid;

the plurality of first row heat transfer tubes and the plurality of second row heat transfer tubes are staggered relative to each other in the row direction by ½ of the tube pitch;

the second row protuberance further comprises a wing portion tapering toward an upstream side as an upstream portion adjacent to the cut-out; and a portion or an entirety of the wing portion of the second row protuberance is located upstream of a line passing through respective centers of the plurality of second row heat transfer tubes, with respect to the first fluid.

17. The fin-tube heat exchanger according to claim 11, wherein:

when the plurality of heat transfer tubes are defined as a plurality of first row heat transfer tubes, the protuberance is defined as a first row protuberance, and a distance between centers of two of the first row heat transfer tubes that are adjacent in the row direction is defined as a tube pitch, the fin-tube heat exchanger further comprises a plurality of second row heat transfer tubes for passing the second fluid, the plurality of heat transfer tubes penetrating the plurality of heat transfer fins and being arranged in the row direction;

a second row protuberance protruding from a surface of the fin, the second row protuberance being provided between two adjacent ones of the second row heat transfer tubes; and a hole formed along an upstream portion of the protuberance with respect to the flow direction of the first fluid;

the plurality of first row heat transfer tubes and the plurality of second row heat transfer tubes are staggered relative to each other in the row direction by ½ of the tube pitch;

the second row protuberance further comprises a wing portion tapering toward an upstream side as an upstream portion adjacent to the hole; and a portion or an entirety of the wing portion of the second row protuberance is located upstream of a line passing through respective centers of the plurality of second row heat transfer tubes, with respect to the first fluid.

18. The fin-tube heat exchanger according to claim 16, wherein:

each of the first and second row protuberances is a remaining portion after the cut-out is formed in such a manner that the wing portion is formed in a hump protruding from a fin basal plane before forming the cut-out; and the hump that becomes a foundation of the first row protuberance and the hump that becomes a foundation of the second row protuberance partially overlap with each other, when viewed in the row direction.

19. The fin-tube heat exchanger according to claim 17, wherein:

each of the first and second row protuberances is a remaining portion after the hole is formed in such a manner that the wing portion is formed in a hump protruding from a fin basal plane before forming the hole; and the hump that becomes a foundation of the first row protuberance and the hump that becomes a foundation of the second row protuberance partially overlap with each other, when viewed in the row direction.

* * * * *